US009192002B2

(12) United States Patent
Morales

(10) Patent No.: US 9,192,002 B2
(45) Date of Patent: Nov. 17, 2015

(54) AC/DC CONVERSION BYPASS POWER DELIVERY

(71) Applicant: iSine, Inc., Ronkonkoma, NY (US)

(72) Inventor: Louis J. Morales, Somerville, MA (US)

(73) Assignee: iSine, Inc., Ronkonkoma, NY (US)

( * ) Notice: Subject to any disclaimer, the term of this patent is extended or adjusted under 35 U.S.C. 154(b) by 519 days.

(21) Appl. No.: 13/681,684

(22) Filed: Nov. 20, 2012

(65) Prior Publication Data

US 2014/0139109 A1 May 22, 2014

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
CPC .... H05B 37/02; H05B 33/08; H05B 33/0845; H05B 33/0812; H05B 33/0815
USPC ..... 315/121, 201, 291, 297, 307
See application file for complete search history.

(56) References Cited

U.S. PATENT DOCUMENTS 8,941,323 B1 * 1/2015 Wu et al. ..... 315/291
2012/0092897 A1 * 4/2012 Hara et al. ..... 363/16
2013/0313991 A1 * 11/2013 Pan et al. ..... 315/201

* cited by examiner

*Primary Examiner* — Thai Pham
(74) *Attorney, Agent, or Firm* — Sterne, Kessler, Goldstein & Fox P.L.L.C.

(57) ABSTRACT

An LED lamp control circuit directly drives an array of series or parallel connected LEDs with current directly derived from the rectified AC voltage. Electrolytic capacitors are eliminated, and the circuit is independent of forward bias voltage of the LEDs, which vary by lot and manufacturer. For example, in an embodiment, an light-emitting diode (LED) lamp control circuit includes a transistor, an LED load comprising one or more LEDs, a power storage device configured to provide power to the LED load, and a controller circuit configured to control the transistor to charge and discharge the power storage device based on sensed voltages of a first node and a second node and a current passing through the power storage device. The power storage device and the LED load are arranged in parallel between the first node and the second node. A voltage source is coupled to the first node and a first terminal of the transistor is coupled to the second node. A second terminal of the transistor is coupled to ground.

16 Claims, 3 Drawing Sheets

AC/DC CONVERSION BYPASS POWER DELIVERY

BACKGROUND

1. Field

The present invention generally relates to electrical circuitry for delivering power to a load directly from a rectified AC voltage, and more particularly relates to delivering power to LED-based lighting products.

2. Background Art

Recently, there has been great interest in reducing the energy consumption of lighting sources, as well as in reducing the size and costs of the lighting sources while also increasing the lifetime of such products. Since it is well known that conventional incandescent light bulbs waste a significant amount of energy in the form of heat, alternatives to incandescent lighting are seen as a possible means of reducing energy consumption. Fluorescent lighting and light emitting diode (LED) lighting are two alternative forms of lighting.

An LED is a well-known semiconductor device comprising a PN junction that emits light when forward-biased. Conventional control circuits for LED-based lighting products typically consist of two circuit portions. A first one of the two circuit portions is an AC-to-DC converter. In some instances these AC-to-DC converters include power factor correction circuitry. A second one of the two aforementioned circuit portions is a current controller coupled to drive a plurality of LEDs in series, in parallel, or in both series and parallel, depending on the desired wattage, voltage, and/or light output. Conventional versions of these circuits require various nodes therein to operate at relatively high voltages, and further require the presence of capacitors having high capacitance values. There are a number of different types of capacitor components; however, the only practical type of capacitors for the requirements mentioned above are electrolytic capacitors.

Unfortunately, incorporating electrolytic capacitors into these circuits limits the reliability of LED products generally. In particular, electrolytic capacitors tend to be the electrical component that is among the first to fail in an LED-based lighting product.

What is needed are low-cost, long-life circuits, without electrolytic capacitors, suitable for delivering power to an LED-based lighting product.

BRIEF SUMMARY

Briefly, circuitry, suitable for delivering power to an LED-based lighting product, drives an LED array with current directly derived from a rectified AC voltage. For example, in an embodiment, an light-emitting diode (LED) lamp control circuit includes a transistor, an LED load comprising one or more LEDs, a power storage device configured to provide power to the LED load, and a controller circuit configured to control the transistor to charge and discharge the power storage device based on sensed voltages of a first node and a second node and a current passing through the power storage device. The power storage device and the LED load are arranged in parallel between the first node and the second node. A voltage source is coupled to the first node and a first terminal of the transistor is coupled to the second node. A second terminal of the transistor is coupled to ground.

In another embodiment, a method of charging a power storage device of an LED lamp circuit includes activating a transistor, a first terminal of the transistor being coupled to a first terminal of the power storage device and a second terminal of the transistor being coupled to ground and the power storage device being arranged in parallel with an LED load of the LED lamp circuit, sensing a voltage at a second terminal of the power storage device, sensing a current passing through the power storage device, and determining whether a charge cycle has completed based on the sensed voltage and sensed current, wherein the power storage device is configured to deliver power to the LED load when the charge cycle has completed.

In still another embodiment, a method of discharging a power storage device of an LED lamp circuit includes deactivating a transistor, a first terminal of the transistor being coupled to a first terminal of the power storage device and a second terminal of the transistor being coupled to ground and the power storage device being arranged in parallel with an LED load of the LED lamp circuit, sensing a voltage at the first terminal of the power storage device, and determining whether a discharge cycle has completed based on the sensed voltage, wherein the power storage device is configured to deliver power to the LED during the discharge cycle.

These and other advantages and features will become readily apparent in view of the following detailed description of the invention. Note that the Summary and Abstract sections may set forth one or more, but not all exemplary embodiments of the present invention as contemplated by the inventor(s).

BRIEF DESCRIPTION OF THE DRAWINGS/FIGURES

Embodiments of the invention are described with reference to the accompanying drawings. In the drawings, like reference numbers indicate identical or functionally similar elements. Additionally, the left most digit(s) of a reference number identifies the drawing in which the reference number first appears.

DETAILED DESCRIPTION

Figure 1:
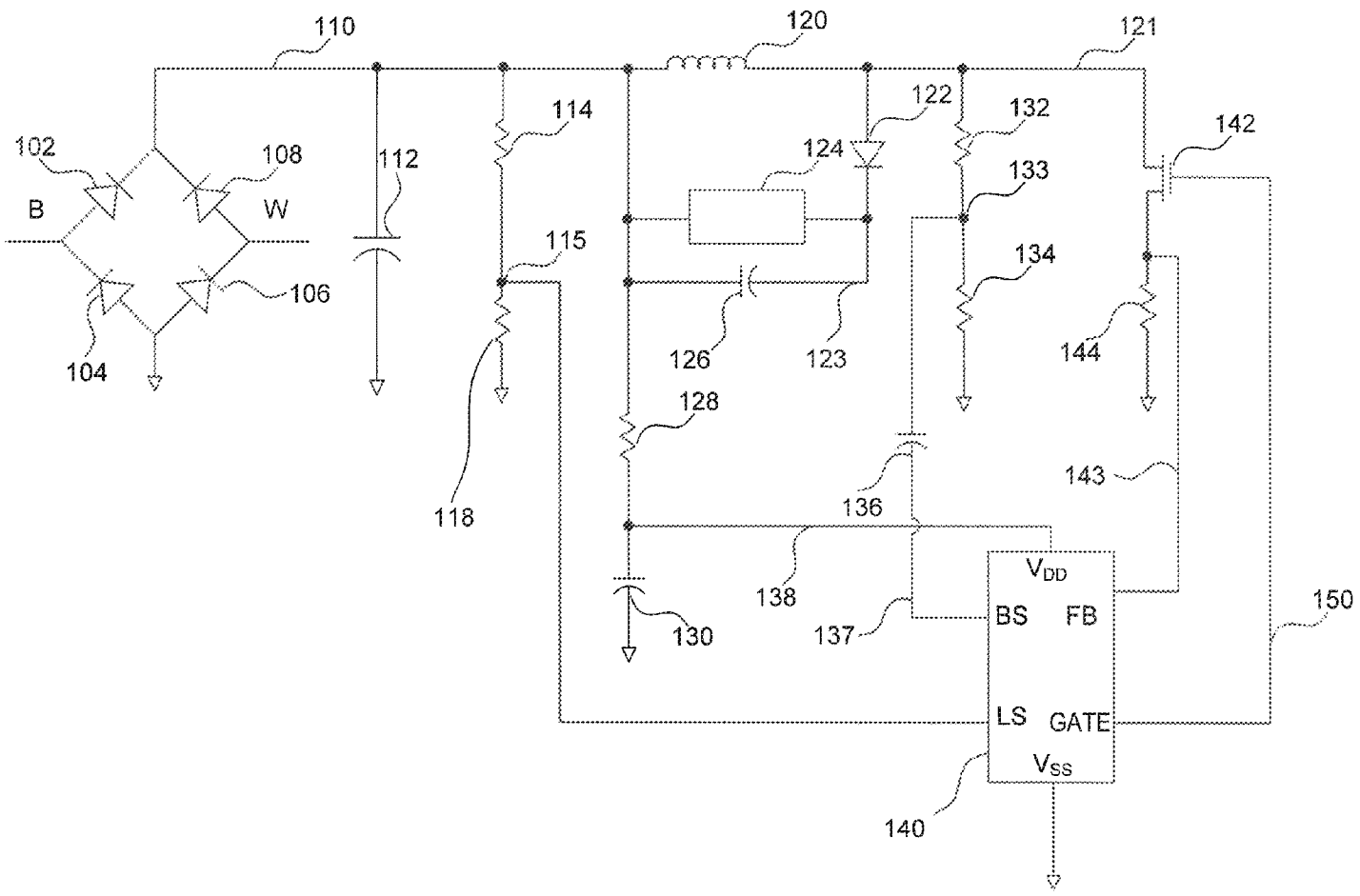
FIG. 1 is a schematic diagram of an illustrative LED lamp control circuit in accordance with the present invention.

The following Detailed Description refers to accompanying drawings to illustrate exemplary embodiments consistent with the invention. References in the Detailed Description to "one exemplary embodiment," "an illustrative embodiment", "an exemplary embodiment," and so on, indicate that the exemplary embodiment described may include a particular feature, structure, or characteristic, but every exemplary embodiment may not necessarily include the particular feature, structure, or characteristic. Moreover, such phrases are not necessarily referring to the same exemplary embodiment. Further, when a particular feature, structure, or characteristic is described in connection with an exemplary embodiment, it is within the knowledge of those skilled in the relevant art(s) to affect such feature, structure, or characteristic in connection with other exemplary embodiments whether or not explicitly described.

The exemplary embodiments described herein are provided for illustrative purposes, and are not limiting. Other exemplary embodiments are possible, and modifications may be made to the exemplary embodiments within the spirit and scope of the invention. Therefore, the Detailed Description is not meant to limit the invention. Rather, the scope of the invention is defined only in accordance with the following claims and their equivalents.

The following Detailed Description of the exemplary embodiments will so fully reveal the general nature of the invention that others can, by applying knowledge of those skilled in relevant art(s), readily modify and/or adapt for various applications such exemplary embodiments, without undue experimentation, without departing from the spirit and scope of the invention. Therefore, such adaptations and modifications are intended to be within the meaning and plurality of equivalents of the exemplary embodiments based upon the teaching and guidance presented herein. It is to be understood that the phraseology or terminology herein is for the purpose of description and not of limitation, such that the terminology or phraseology of the present specification is to be interpreted by those skilled in relevant art(s) in light of the teachings herein.

Terminology

Historically, power factor has referred to the ratio of the real power to the apparent power (a number between 0 and 1, and commonly expressed as a percentage). Real power is the capacity of a circuit to perform work in a particular time. Apparent power is the product of the current and voltage in the circuit, and consists of real power plus reactive power. Due to either energy stored in the load and returned to the source, or to a non-linear load that distorts the wave shape of the current drawn from the source, the apparent power can be greater than the real power. More recently, power factor has come to be defined as $$\frac{\cos\theta}{\sqrt{1+THD^2}}.$$

Where θ is the phase shift from real power, and THD is the total harmonic distortion of the first fifteen harmonics. Low power factor loads increase losses in a power generation system and consequently increase energy costs.

Power factor correction refers to a technique of counteracting the undesirable effects of electric circuits that create a power factor that is less than one.

Vf refers to the forward-bias voltage of an LED. As used herein, unless otherwise noted, Vf is summed across an LED array in an LED-based lighting product.

The term "lamp" refers generally to a man-made source created to produce optical radiation. By extension, the term is also used to denote sources that radiate in regions of the spectrum adjacent to the visible.

The term "luminaire" refers generally to a light fixture, and more particularly refers to a complete lighting unit consisting of lamp(s) and ballast(s) (when applicable) together with the parts designed to distribute the light, position and protect the lamps, and to connect the lamp(s) to the power supply.

The expression "LED luminaire" refers to a complete lighting unit that includes LED-based light emitting elements (described below) and a matched driver together with parts to distribute light, to position and protect the light emitting elements, and to connect the unit to a branch circuit or other overcurrent protector. The LED-based light emitting elements may take the form of LED packages (components), LED arrays (modules), LED Light Engine, or LED lamps. An LED luminaire is intended to connect directly to a branch circuit.

The expression "Solid State Lighting" (SSL) refers to the fact that the light is emitted from a solid object—a block of semiconductor—rather than from a vacuum or gas tube, as in the case of an incandescent and fluorescent lighting. There are at least two types of solid-state light emitters, including inorganic light-emitting diodes (LEDs) or organic light-emitting diodes (OLEDs).

The expression "SSL Downlight Retrofit" refers to a type of solid state luminaire intended to install into an existing downlight, replacing the existing light source and related electrical components.

FET, as used herein, refers to metal-oxide-semiconductor field effect transistors (MOSFETs). These transistors are also known as insulated gate field effect transistors (IGFETs). An n-channel FET is referred to as an NFET. A p-channel FET is referred to as a PFET.

Source/drain terminals refer to the terminals of a FET, between which conduction occurs under the influence of an electric field, subsequent to the inversion of the semiconductor surface under the influence of an electric field resulting from a voltage applied to the gate terminal. Generally, the source and drain terminals of FETs used for logic applications are fabricated such that they are geometrically symmetrical. However, it is common that the source and drain terminals of power FETs are fabricated with asymmetrical geometries. With geometrically symmetrical source and drain terminals it is common to simply refer to these terminals as source/drain terminals, and this nomenclature is used herein. Designers often designate a particular source/drain terminal to be a "source" or a "drain" on the basis of the voltage to be applied to that terminal when the FET is operated in a circuit.

The expression "transfer gate" refers to an NFET and a PFET coupled in parallel for signal conduction between a first node and a second node, and further coupled so that their respective gate terminals receive control signals with substantially the same timing, but having the opposite polarity. In this way, the NFET and PFET are both turned on and turned off at substantially the same time.

The term "nominal" as used herein refers to a desired, or target, value of a characteristic or parameter for a component or a signal, set during the design phase of a product, together with a range of values above and/or below the desired value. The range of values is typically due to slight variations in manufacturing processes or tolerances. By way of example and not limitation, a resistor may be specified as having a nominal value of 10KΩ, which would be understood to mean 10KΩ plus or minus a certain percentage (e.g., ±5%) of the specified value.

With respect to the various circuits, sub-circuits, and electrical circuit elements described herein, signals are coupled between them and other circuit elements via physical, electrically conductive connections. It is noted that, in this field, the point of connection is sometimes referred to as an input, output, input/output (I/O), terminal, line, pin, pad, port, interface, or similar variants and combinations.

Various embodiments of the present invention bypass the AC-to-DC conversion circuit found in conventional control circuitry for LED-based lighting products, and drive the LED array (series/parallel) with current directly derived from the rectified AC voltage.

In a further aspect, various embodiments of the present invention drive the LED supply current in proportion to the rectified AC line voltage, thereby providing a high power factor.

In a still further aspect, various embodiments of the present invention are independent of the forward bias voltage of the LEDs, which tend to vary by lot and manufacturer.

Illustrative Circuitry

Referring to FIG. 1, an illustrative circuit includes the AC line power nodes B and W (e.g., 120V and preferably after a line filter, not shown) coupled to a bridge rectifier. The bridge rectifier includes diodes 102, 104, 106 and 108. As is well understood in the field a diode is a two-terminal device having an anode and a cathode. The bridge rectifier of FIG. 1 is configured such that diode 102 is coupled anode-to-cathode between power supply node B and rectified voltage output node 110. Diode 104 is coupled anode-to-cathode between a ground node ("ground") and power supply node B. Diode 106 is coupled anode-to-cathode between ground and power supply node W. Diode 108 is coupled anode-to-cathode between power supply node W and rectified voltage output node 110. A capacitor 112, having a nominal capacitance of 0.01 μF, is coupled between rectified voltage output node 110 and ground. A resistor 114, having a nominal resistance of 300KΩ, is coupled between rectified voltage output node 110 and a node 115. A resistor 118, having a nominal resistance of 2.7KΩ, is coupled between node 115 and ground. A resistor 128, having a nominal resistance of 40KΩ, is coupled between rectified voltage output node 110 and a node 138. A capacitor 130, having a nominal capacitance of 4.7 μF, is coupled between node 138 and ground. An inductor 120, having a nominal inductance of 470 μH, is coupled between rectified voltage output node 110 and a node 121. A diode 122 is coupled anode-to-cathode between node 121 and a node 123. A capacitor 126, having a nominal capacitance of 0.2 μF is coupled between rectified voltage output node 110 and node 123. A resistor 132, having a nominal resistance of 300KΩ, is coupled between node 121 and a node 133. A resistor 134, having a nominal resistance of 8KΩ, is coupled between node 133 and ground. An NFET 142 is coupled drain-to-source between node 121 and a node 143. A resistor 144, having a nominal resistance of 0.14Ω, is coupled between the drain of NFET 142 (i.e., node 143) and ground. The gate terminal of NFET 142 is coupled to node 150.

A receptacle 124, is coupled between rectified voltage output node 110 and node 123. The LEDs that are driven from the circuit of FIG. 1 are connected to the circuit by way of receptacle 124 (e.g., via two connectors that are not shown in FIG. 1). The LEDs provide the load to the circuit.

Still referring to FIG. 1, a subcircuit 140, having six labeled terminals is shown. The terminal labeled Vss is connected to ground. The terminal labeled Vdd is connected to node 138. The input terminals FB, BS, LS, and GATE are coupled respectively to node 143, node 137, node 115, and node 150.

Figure 2:
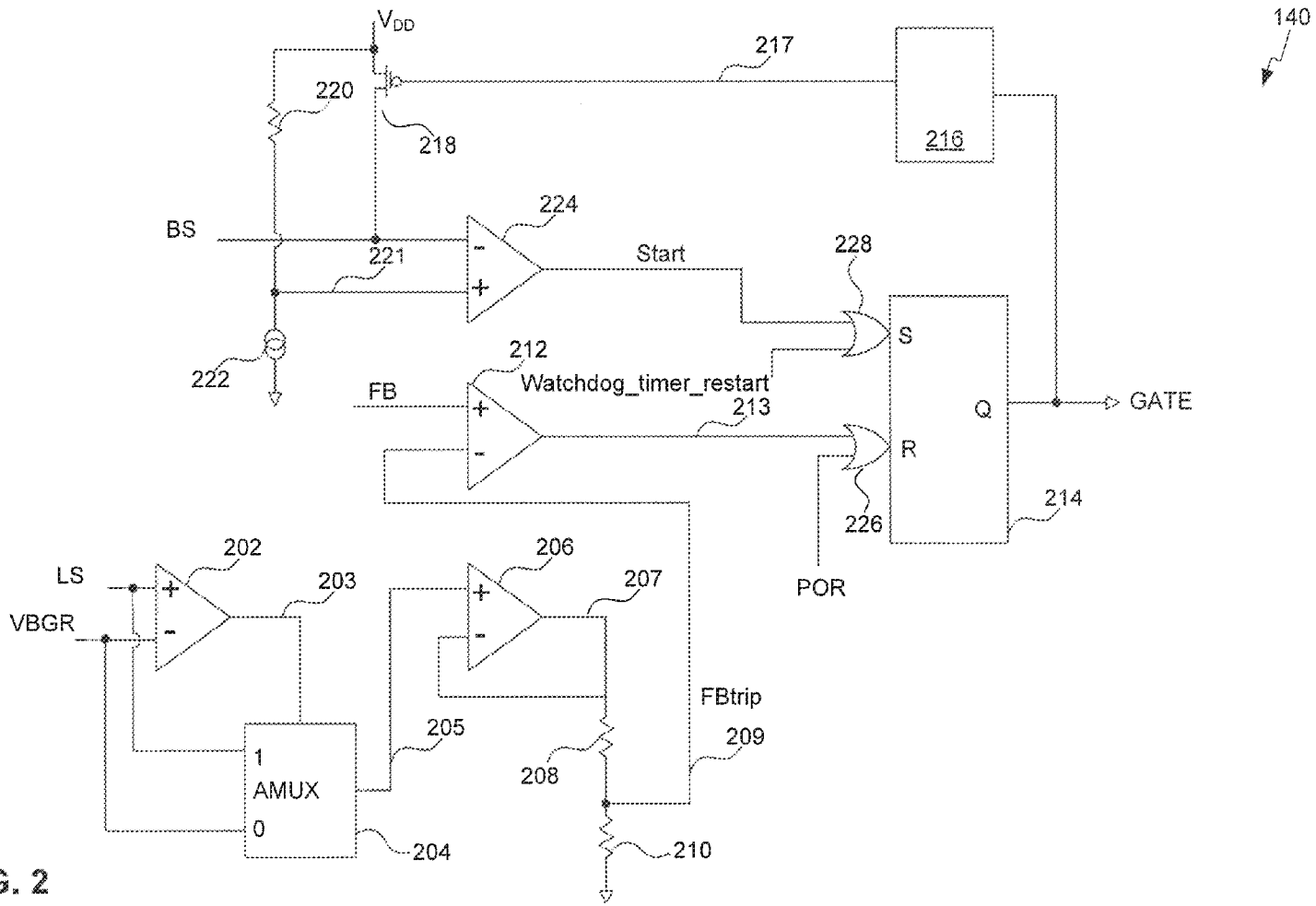
FIG. 2 is a schematic diagram of an illustrative controller circuit within the LED lamp control circuit.

FIG. 2 is a schematic diagram that provides details of subcircuit 140 of the illustrative embodiment of FIG. 1. Subcircuit 140 is shown only in block form representation in FIG. 1. Referring to FIGS. 1 and 2, an input terminal (labeled 'LS') of subcircuit 140 is coupled to a non-inverting input terminal of a comparator 202. As can be seen in FIG. 1, input terminal LS is coupled to node 115. Input terminal LS (i.e., node 115) is further coupled to a first analog input terminal of a 2-to-1 analog multiplexor 204.

A signal source (labeled 'VBGR') from a bandgap voltage reference generator (not shown) is coupled to an inverting input of comparator 202. As would be appreciated by those skilled in the art based on the disclosure herein, a bandgap voltage reference generator can provide a substantially constant reference voltage irrespective of ambient conditions (e.g., temperature). Signal source VBGR is further coupled to a second analog input terminal of the 2-to-1 multiplexor 204. An output terminal of comparator 202 is coupled to a selector input terminal of 2-to-1 analog multiplexor 204. An output terminal of 2-1 analog multiplexor 204 is coupled to a node 205. Node 205 is further coupled to a non-inverting input terminal of op amp 206. The output of op amp 206 is coupled to node 207. Node 207 is further connected to the inverting input of op amp 206. A resistor 208, is coupled between node 207 and a node 209. A resistor 210, is coupled between node 209 and ground. Alternatively, resistors 208 and 210 may be omitted and node 207 joined with node 209.

Still referring to FIG. 2, subcircuit 140 includes a resistor 220, having a nominal resistance of 17.5KΩ, coupled between Vdd (i.e., node 138) and a node 221. A current source 222 is coupled between node 221 and ground. A PFET 218 is coupled source-to-drain between Vdd and the inverting input terminal of a comparator 224. The non-inverting input terminal of comparator 224 is coupled to node 221. An input terminal (labeled 'BS') is coupled to node 137 (shown in FIG. 1). An output terminal of comparator 224 (labeled 'start') is coupled to a first input terminal of two-input OR gate 228. A signal source (labeled watchdog_timer_restart) is coupled to a second input terminal of two-input OR gate 228. The output terminal of two-input OR gate 228 is coupled to a SET input terminal of Set-Reset Flip Flop 214.

Figure 3:
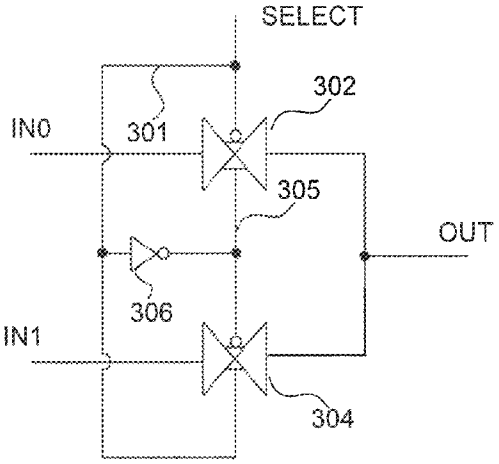
FIG. 3 is a schematic diagram of a two-to-one analog multiplexer.

FIG. 3 is a schematic diagram of an illustrative two-to-one analog multiplexer 204. A first transfer gate 302 has an input terminal labeled IN0 and an output terminal coupled to a node labeled OUT. A second transfer gate 304 has an input terminal labeled IN1 and an output terminal coupled to the node labeled OUT. An inverter 306 has an input terminal coupled to a node 301, and an output terminal coupled to a node 305. An inverting control input terminal 310 of transfer gate 302 and a non-inverting control input terminal 316 of transfer gate 304 are each coupled to node 301. A non-inverting control input terminal 312 of transfer gate 302 and an inverting control input terminal 314 of transfer gate 304 are each coupled to the output of inverter 306 at node 305.

Figure 4:
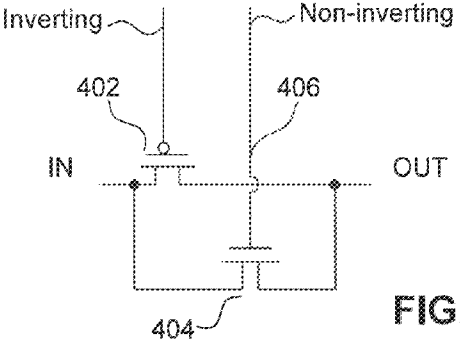
FIG. 4 is a schematic diagram of a transfer gate formed from an NFET and a PFET.

FIG. 4 is a schematic diagram of an illustrative transfer gate 304 formed from an NFET and a PFET. More particularly, a PFET 402 is coupled source-to-drain between an input node, IN, and an output node, OUT. An NFET 404 is also coupled source-to-drain between IN and OUT. A node 406 is coupled to the gate terminal of NFET 404, and a node 408 is coupled to the gate terminal of PFET 402. In operation, node 406 is further coupled to a first signal source (labeled SELECT), and node 408 is coupled to an input terminal of an inverter 410. When SELECT is high, node 408 is driven low by inverter 410, and both NFET 404 and PFET 402 are turned on. When SELECT is low and 408 is driven high by inverter 410, both NFET 404 and PFET 402 are turned off.

Figure 5:
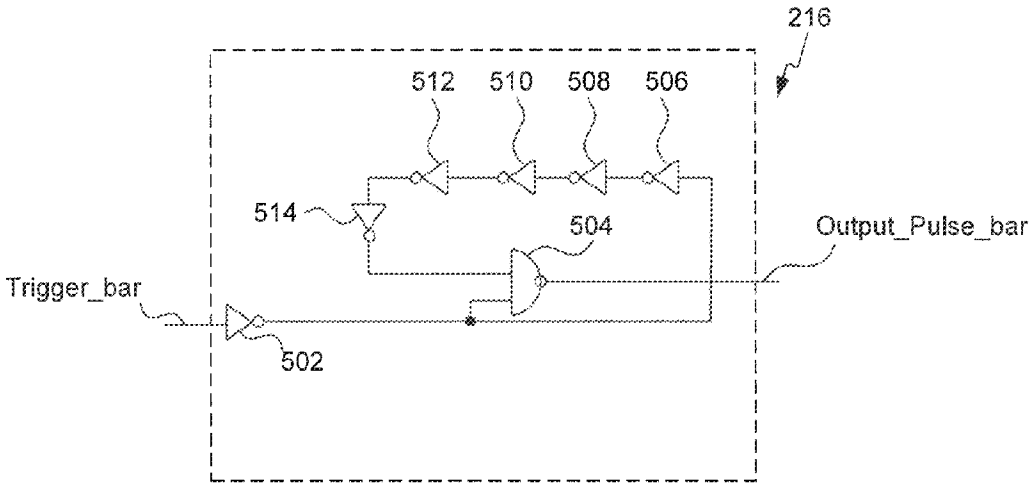
FIG. 5 is a schematic diagram of a one-shot (sometimes referred to as a mono-stable multi-vibrator) suitable for use in generating a pulse that is initiated on the falling edge of an input signal.

FIG. 5 is a schematic diagram of an illustrative one-shot 216 (historically referred to as a mono-stable multi-vibrator) suitable for use in generating a pulse that is initiated on the falling edge of an input signal. Illustrative one-shot 216 includes an inverter, a NAND gate and an inverting delay chain to control the width of the one-shot output pulse. The signal that is coupled to the input terminal of one-shot 216 in operation is labeled TRIGGER-bar (it is low when it is asserted and otherwise high). The signal that is available in operation at the output terminal of one-shot 216 is labeled OUTPUT_PULSE-bar. A high-to-low transition on the one-shot input terminal triggers the output pulse. More particularly, the input labeled TRIGGER-bar is connected to the input of an inverter 502. The output of inverter 502 is connected to a first input terminal of NAND gate 504. The output terminal of inverter 502 is further coupled to an input terminal of an inverter 506. An output terminal of inverter 506 is coupled to an input terminal of an inverter 508 and an output terminal of inverter 508 is coupled to an input terminal of inverter 510. An output terminal of inverter 510 is coupled to an input terminal of an inverter 512 and an output terminal of inverter 512 is coupled to an input terminal of inverter 514. An output terminal of inverter 514 is coupled to a second input terminal of NAND gate 504.

It is noted that there are other very well-known one-shot circuit configurations from which designers may choose. Any suitable circuit that produces an output pulse from low-going transition of an input signal may be used.

Illustrative Operation

Referring again to FIG. 1, the AC line power goes through a line filter (not shown) followed by a bridge rectifier generating a basic rectified AC voltage, node 110, which is supplied to the inductor 120. The principal circuit elements of this illustrative embodiment are an inductor 120, an LED load 124 (individual or series parallel assembly of LEDs), and an NFET switch 142, the gate of which is controlled by controller circuit 140. Inductor 120 and the LED load 124 are connected in parallel between node 110 and node 121. NFET 142 is controlled to selectively drive node 121 close to ground. When NFET 142 is activated, current runs from node 110 to node 121 through inductor 120 (LED load is reverse biased) and NFET 142. When NFET 142 is released, the energy in inductor 120 drives current from node 110 to node 121 which returns through the LED load 124 to node 110. In this way, power is delivered to the LED load 124, in two steps: 1) store energy in the inductor 120 to a desired level, 2) deliver energy stored in inductor 120 to the LED load 124.

Inductor 120 is alternately charged and discharged in order to deliver the power to the LED load 124 in a desired shape, generally approximating the square of the voltage shape. In some embodiments, in order to reduce peak LED current, the desired shape of the power delivered to the LED load 124 is flattened at the peaks, somewhat reducing power factor. The voltage at node 115 determines the shape of the current charged. This current times the voltage at node 110 is the energy charged in inductor 120. Once the current in inductor 120 reaches a level proportional to the voltage at node 115, NFET 142 is released beginning a discharge cycle. Moreover, controller circuit 140 can also be configured limit the peak current in inductor 120 to a predetermined value. Thus, controller circuit 140, by controlling NFET 142, can impose two different limits or bounds on the peak current through inductor 120: (1) a value proportional to the voltage at node 115 and (2) a predetermined maximum value. The voltage at node 137 is monitored by the controller circuit 140 to sense when the energy in inductor 120 has been discharged into the LED load 124, beginning a new charging cycle.

Resistor RFB, having a low resistance value, is used to sense the charge current. Resistor RFB is electrically coupled between NFET 142 and ground. When the voltage across this resistor reaches a predetermined value, ⅕ of the voltage at node 115 in this illustrative embodiment, the charge cycle is ended and NFET 142 is turned off. In this illustrative embodiment node 115 input voltages in excess of a fixed voltage level, VBGR, are limited to VBGR. The shape of the power waveform delivered can therefore be flattened by choosing the ratio between resistor 114 and resistor 118 so that peak voltages at node 115 are clipped. When NFET 142 is turned off, node 121 immediately goes from near ground to approximately the voltage at node 110 plus the Vf of the LED load 124, which begins the discharge cycle.

During the discharge cycle voltage at node 121 starts at approximately the voltage at node 110 plus the Vf of the LED load 124 and declines following the forward bias curve of the LED load 124. In this illustrative embodiment, the end of the discharge cycle is detected using a resistor divider on node 121 and AC coupling the divided voltage at node 121 to node 137. During the charge cycle (NFET 142 active) node 137 is pre-charged to VDD by controller circuit 140 via the BS pin. When BS drops significantly below VDD a new charge cycle is started (NFET 142 activated).

The energy level in inductor 120 approximates a triangle wave. During the charging cycle, the current in inductor 120 increases linearly. Once released, the current in inductor 120 discharges roughly linearly. The slope of the current through inductor 120 during the charging cycle is proportional to the voltage at node 110. During the discharge cycle, the downward slope of the current through inductor 120 is proportional to the forward bias voltage of the LED load 124. Therefore average current in inductor 120 is approximately equal to the peak current divided by two. Power is charged in inductor 120 during the charge cycle time. This charge power is delivered during the discharge time. Power delivered is therefore approximately equal to the voltage at node 110 times the peak current though inductor 120 divided by two (triangle shape) times the ratio of the charge time to the sum of the charge and discharge times.

In order to shape the power delivered to approximate the voltage at node 110, the voltage at node 115 should be a DC voltage. Peak current delivered in each charge cycle will be fixed. While simple, this may have a power factor below 0.9 in practice.

In order to shape the power delivered to approximate V_node 110 squared, the LS input should be driven by a divided V_node 110. Peak current delivered in each charge cycle will be (V_node 110/4)(V_node 110_divide_factor*RFB). While the squared shape is better for power factor, this method has two drawbacks: a) this results in no current being drawn when the line voltage is 0; not good for triac dimmer control, b) peak current is 1.41 times greater than average current, meaning larger LED load 124 than the application would need for the average case power.

The LED load 124 may be complimented by a parallel capacitor 126 and a series diode 122 While lowering efficiency the peak current through the LED load 124 is greatly reduced resulting in longer LED life and better color rendering control.

The core supply voltage for the illustrative embodiment is limited by an internal shunt regulator to about 5.5V. The simplest means to generate this voltage is with a resistor from node 110 to VDD, in addition to a 4.7 uF capacitor to ground.

A small capacitor 112 from node 110 to ground may be beneficial in order to present a low impedance to inductor 120 during switching.

The charge/discharge cycle time is generally much faster than the AC line frequency. Higher switching frequencies result in smaller components and less ripple. Practical upper limits to this are the bandwidth of NFET 142 and inductor 120; also consideration to regulatory requirements for radiated and conducted noise must be taken into account. Frequencies between 170 KHz and 1.5 MHz may be used. The frequency is determined by the values of inductor 120, lamp power, line voltage, and the Vf of the LED load 124.

Once a charge or discharge cycle is started it will not be stopped for at least 300 ns. This prevents improper re-cycling due to transient conditions at cycle boundaries. For example, NFET 142 has a turn-on time of tens of nanoseconds after the gate is enabled. Also, there are buffering delays from the signal initiating the start of a charge cycle and the gate being driven. If node 137 is sensed during the fall time of the voltage at node 121 at the beginning of a charge cycle, a false start of a discharge cycle may occur.

Referring to FIG. 2, control of the charge and discharge cycles is implemented in three functions: discharge completion detection, charge completion detection, and waveform control.

A charge cycle begins when the voltage of BS signal is lower than voltage of signal 221, causing comparator 224 to go high and, in turn, setting set/reset flip-flop 214, which, in turn, enables GATE signal. Signal 221 is set at a fixed offset below Vdd using a fixed bias current generator 222 and resistor 220, e.g., to about 0.3V. BS is pre-charged to Vdd for a short time defined by one-shot circuit 216. During this pre-charge time, signal 217 is held low, thereby turning on PFET 218, which pre-charges BS. By holding the pre-charge at the beginning of the discharge cycle, false detection of discharge completion is avoided.

If there was no previous charge cycle, the discharge detection will not initiate a subsequent charge cycle. A charge cycle is initiated by a watchdog timer to prevent the control logic from being stuck in this way.

A given charge cycle ends when the current delivered to the inductor reaches a target level. The voltage on FB is proportional to the current delivered to the inductor. The desired current level is represented as the voltage at node 209. When the voltage of FB exceeds the voltage at node 209, comparator 212 causes the node 213 to go high, which, in turn, causes a reset of set/reset flip-flop 214 through OR gate 226, thereby ending the charge cycle. OR gate 226 also receives input from a power-on reset (POR) block (not shown in FIG. 2).

The LS signal in conjunction with a fixed voltage signal VBGR sets the target current shape. It can also be desirable to have the target current follow the line voltage for best power factor. However, it may also be desirable to minimize the peak current in the LED load for longevity of the LEDs. For this reason, the maximum current can be limited at the expense of power factor. To implement this feature, signal LS is made to follow the line voltage, but scaled to a lower voltage level. The voltage level is chosen so that the maximum limit desired is equal to the fixed voltage VBGR. Comparator 202 in conjunction with analog mux 204 implement a clipping circuit, causing the signal 205 voltage to match the lower voltage of LS or VBGR.

Op amp 206 is connected as a unity gain butter followed by resistor divider 208 and 210. This circuit results in node 209 voltage to follow a scaled-down version of the voltage at node 205. This allows a low target voltage to be achieved with high voltage levels at LS. In an embodiment, this makes the circuit more immune to noise.

The target current shape can be scaled to achieve a desired power level by choosing the value RFB of current sensing resistor 144.

For the ease of discussion, certain functional blocks have been omitted from FIGS. 1 and 2. As would be appreciated by those skilled in the relevant art(s), the circuits shown in FIGS. 1 and/or 2 may additionally include a bandgap voltage reference generator, a power-on reset block, a shunt regulator, and/or a bias generator.

Various embodiments of the present invention provide LED lamp control circuitry that drives an LED array with current directly derived from the rectified AC voltage. Moreover, various embodiments of the present invention may find application in lighting or illumination.

CONCLUSION

It is to be appreciated that the Detailed Description section, and not the Abstract of the Disclosure, is intended to be used to interpret the claims. The Abstract of the Disclosure may set forth one or more, but not all, exemplary embodiments of the invention, and thus, is not intended to limit the invention and the subjoined Claims in any way.

It will be apparent to those skilled in the relevant art(s) that various changes in form and detail can be made therein without departing from the spirit and scope of the invention. Thus the invention should not be limited by any of the above-described exemplary embodiments, but should be defined only in accordance with the subjoined Claims and their equivalents.

What is claimed is:

1. A light-emitting diode (LED) lamp control circuit, comprising:

a transistor;

an LED load comprising one or more LEDs;

a power storage device configured to provide power to the LED load, wherein the power storage device and the LED load are arranged in parallel between a first node and a second node, wherein a voltage source is coupled to the first node and a first terminal of the transistor is coupled to the second node, and wherein a second terminal of the transistor is coupled to ground;

a controller circuit configured to control the transistor to charge and discharge the power storage device based on sensed voltages of the first and second nodes and a current passing through the power storage device.

2. The LED lamp control circuit of claim 1, wherein the power storage device comprises an inductor.

3. The LED lamp control circuit of claim 1, wherein the voltage source provides alternating current (AC) power and wherein the first node is connected to a rectifier circuit.

4. The LED lamp control circuit of claim 1, further comprising:

a resistor having first and second terminals, wherein the first terminal of the resistor is connected to the second terminal of the transistor and the second terminal of the resistor is connected to ground, wherein the controller circuit is configured to determine the current passing through the power storage device based on a voltage at the first terminal of the resistor.

5. The LED lamp control circuit of claim 4, wherein the controller circuit is configured to activate the transistor while the voltage at the first terminal of the resistor remains below a predetermined percentage of the voltage at the first node.

6. The LED lamp control circuit of claim 5, wherein the controller circuit is configured to sense the voltage at the first node through a voltage divider.

7. The LED lamp control circuit of claim 6, wherein the controller circuit is configured to limit a peak current delivered to the power storage device to a value proportional to the voltage at the first node.

8. The LED lamp control circuit of claim 7, wherein the controller circuit is configured to limit the peak current delivered to the power supply to a predetermined maximum value.

9. The LED lamp control circuit of claim 1, wherein the controller circuit is configured to deactivate the transistor while the voltage at the second node is below a predetermined threshold.

10. The LED lamp control circuit of claim 9, wherein the predetermined threshold depends on a supply voltage of the controller circuit.

11. The LED lamp control circuit of claim 9, wherein the controller circuit is configured to sense the second voltage through a capacitor.

12. The LED lamp control circuit of claim 11, wherein the controller circuit is configured to sense the second voltage through a voltage divider.

13. The LED lamp control circuit of claim 1, further comprising:

a diode coupled between the power storage device and the LED load; and a capacitor arranged in parallel between the first and second nodes with the power storage device and the LED load.

14. The LED lamp control circuit of claim 1, wherein the controller circuit is configured to switch from charging to discharging after a predetermined maximum charging time has elapsed.

15. The LED lamp control circuit of claim 1, wherein the controller circuit is configured to switch from discharging to charging after a predetermined maximum discharging time has elapsed.

16. A light-emitting diode (LED) lamp control circuit, comprising:

a transistor;

an LED load comprising one or more LEDs;

a power storage device configured to provide power to the LED load, wherein the power storage device and the LED load are arranged in parallel between a first node and a second node, wherein a voltage source is coupled to the first node and a first terminal of the transistor is coupled to the second node, and wherein a second terminal of the transistor is coupled to ground;

a controller circuit configured to control the transistor to charge and discharge the power storage device based at least in part on sensed voltages of the first and second nodes and a current passing through the power storage device, and based at least in part on a state of a watchdog timer.

* * * * *